United States Patent [19]

Denier et al.

[11] Patent Number: 4,687,007

[45] Date of Patent: Aug. 18, 1987

[54] PROCESS FOR DRYING AND EXPANDING TOBACCO

[75] Inventors: Robert F. Denier, Louisville, Ky.; Robert H. Marshall, New Albany, Ind.

[73] Assignee: Brown & Williamson Tobacco Corporation, Louisville, Ky.

[21] Appl. No.: 832,300

[22] Filed: Feb. 24, 1986

[51] Int. Cl.[4] ..... A24B 3/12; A24B 3/18

[52] U.S. Cl. ..... 131/296; 131/302; 131/303; 131/304; 131/309

[58] Field of Search ..... 131/296, 309, 260, 304, 131/310, 303

[56] References Cited

U.S. PATENT DOCUMENTS 4,494,556 1/1985 Wu et al. ..... 131/303

*Primary Examiner*—V. Millin

*Attorney, Agent, or Firm*—Charles G. Lamb

[57] ABSTRACT

An improved tobacco treating process for smoking articles including the steps of introducing tobacco to be dryed into a restricted pressure and flow controllable system to be entrained by pressurized stream for preselected residence time before disentrainment therefrom, the steam being held at preselected minimum pressure and velocity to improve fill value and smoking quality of the tobacco.

19 Claims, 3 Drawing Figures

PROCESS FOR DRYING AND EXPANDING TOBACCO

BACKGROUND OF THE INVENTION (1) Field of the Invention

The invention relates to tobacco drying processes and, more particularly, to a process for drying tobacco at controlled pressures above atmospheric to improve the smoking quality of tobacco and concomitantly increase tobacco fill value.

(2) Description of the Prior Art

It is generally well known in the art to dry tobacco destined for smoking articles such as cigarettes and the like at high temperatures, the tobacco having an initial moisture content usually above 16%. It also is well known in the food processing art to produce food stuffs by entraining a material such as food stuffs or pulp in a pressurized heated gas stream in suspended condition, thereby heating and conveying the material, and then discharging the material to a zone of lower pressure.

For example, U.S. Pat. No. 3,357,436, issued to A. H. Wright on Dec. 12, 1967 teaches improving tobacco fill valve by drying tobacco at a temperature range between 250° F. to 600° F. and controlling the moisture content of the tobacco to be dryed to between 16% and 35% to provide dryed tobacco of between 9% and 23% moisture content. U.S. Pat. Nos. 3,661,071 and its divisional No. 3,754,930, both issued to R. Toei et al, on May 9, 1972 and Aug. 28, 1973, respectively, teach the drying of food stuffs in a pressurized heated gas stream and discharging the same to a zone of lower pressure. Further, U.S. Pat. No. 3,734,104, issued to W. Buchanan et al on May 22, 1973, teaches rapidly heating and expanding moisturized tobacco for brief time periods of less than 3 seconds at temperatures as high as 750° F. to increase tobacco fill value and U.S. Pat. No. 4,167,191, issued to J. Jewell et al, on Sept. 11, 1979, teaches drying expanded tobacco by heating tobacco in steam and air at temperatures of 250° F. to 650° F. in the presense of an absolute humidity at a level above that which produces a wet-bulb temperature of at least 150° F. Moreover, two U.S. patents to B. Hedstrom, namely U.S. Pat. Nos. 3.808,093, issued on Apr. 30, 1974, and No. 4,043,049, issued on Aug. 23, 1977, as well as Canadian Pat. No. 879,811, issued on Aug. 31, 1971, teach drying of wood pulp in particulate form in entraining steam at elevated pressure, the steam heating and carrying the particulate pulp through the process. These aforenoted processes when involving tobacco have recognized the desirability of improving smoking quality and filling power but have either operated at atmospheric pressure when tobacco has been involved or, when operating under pressure, have involved food stuffs and wood pulps, requiring extensive and complex equipment in consideration of the nature of the product to be treated.

In accordance with the present invention an improved, straightforward, efficient and economical tobacco drying process is provided which recognizes the advantages and benefits of drying tobacco at both high temperatures and increased pressure but at the same time avoids the usually required extensive, complex and expensive equipment costs involved in high temperature and pressure operations. With the unique and novel process taught by the present invention, it is possible to obtain an improved tobacco product for smoking articles, such as cigarettes, which has smoother smoking qualities with lower impact and irritation properties and with lower nicotine or alkaloid type ingredients and, at the same time, increased fill values.

Various other features of the present invention will become obvious to one skilled in the art upon reading the novel disclosure set forth herein.

SUMMARY OF THE INVENTION

More particularly, the present invention provides a process for drying tobacco comprising: introducing pressurized superheated steam into a restricted pressure and flow controllable system; controlling the pressure differential and velocity flow of the superheated steam across the system so that the steam is at a preselected velocity to entrain and a preselected minimum pressure to improve the smoking quality and fill value of tobacco to be introduced into the system; introducing tobacco to be drying through a first gas lock into the system to be entrained by the pressurized superheated steam for a preselected residence time in the system; disentraining the tobacco from the pressurized superheated steam at the end of the residence time; and discharging the disentrained tobacco from the system through a second gas lock into a zone of lower pressure. In addition, the present invention provides a novel and inexpensive process for introducing the tobacco into the drying system, for increasing the superheated steam velocity, for increasing steam temperature and residence time and for improving convective heat transfer coefficients to the tobacco. It is to be understood that various changes can be made by one skilled in the art in one or more of the steps of the inventive process set forth herein without departing from the scope or spirit of the present invention.

BRIEF DESCRIPTION OF THE DRAWINGS

Referring to the drawings which disclose one advantageous embodiment of the present invention.

DETAILED DESCRIPTION OF THE INVENTION

Figure 1:
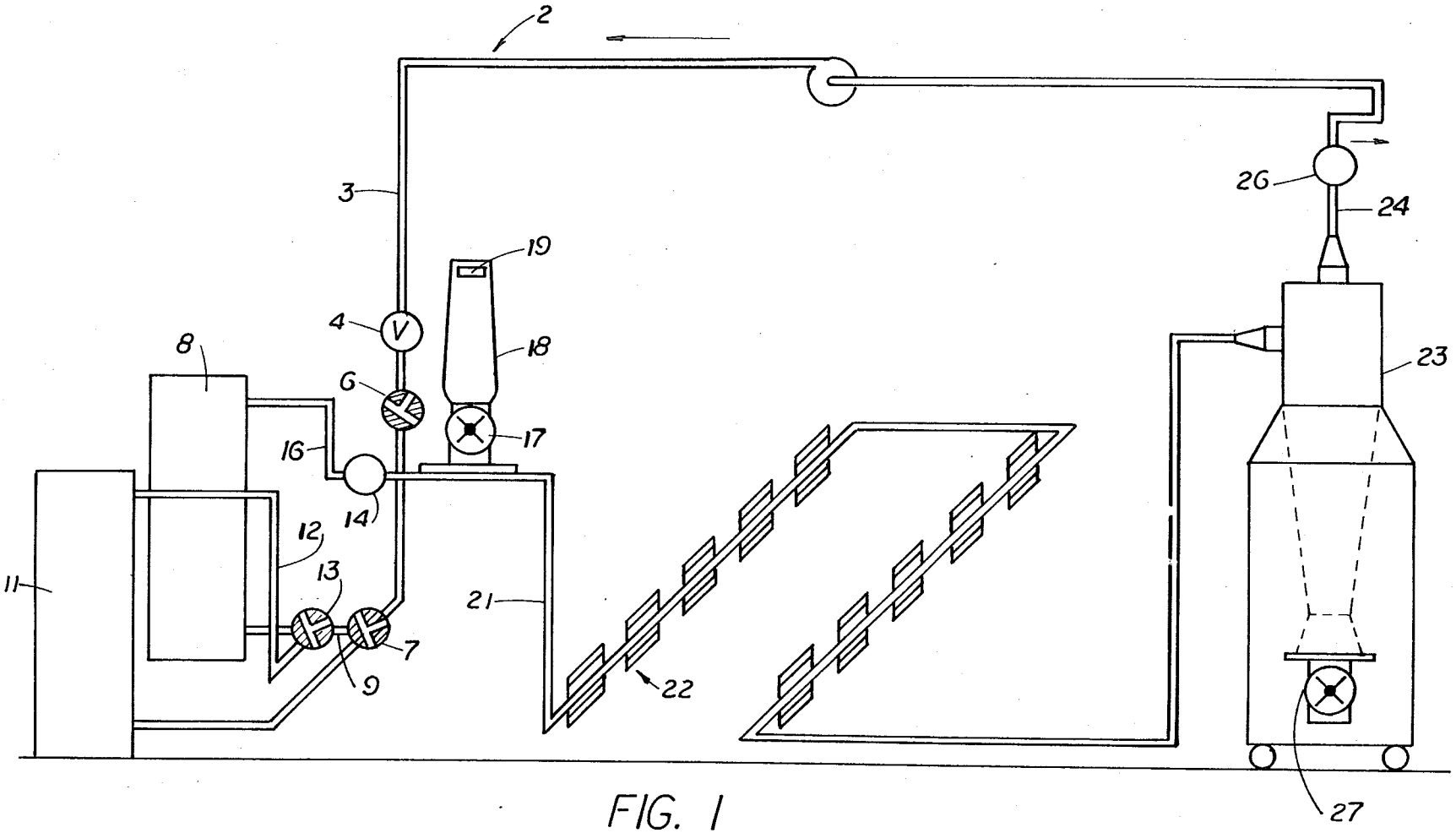
FIG. 1 is a schematic flow diagram of the apparatus used to carry out the inventive process.
Figure 2:
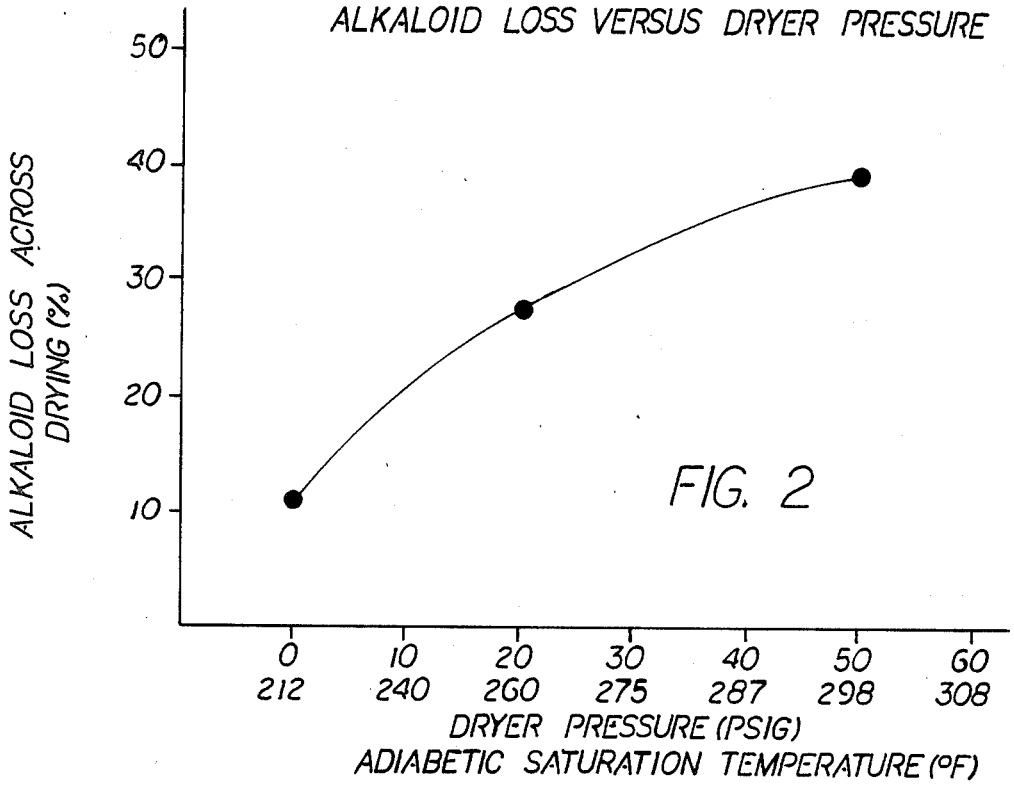
FIG. 2 is a graph depicting alkaloid losses at varying steam drying pressures and temperatures; and, FIG. 3 is a graph depicting fill value changes at varying steam drying pressures and temperatures.
Figure 3:
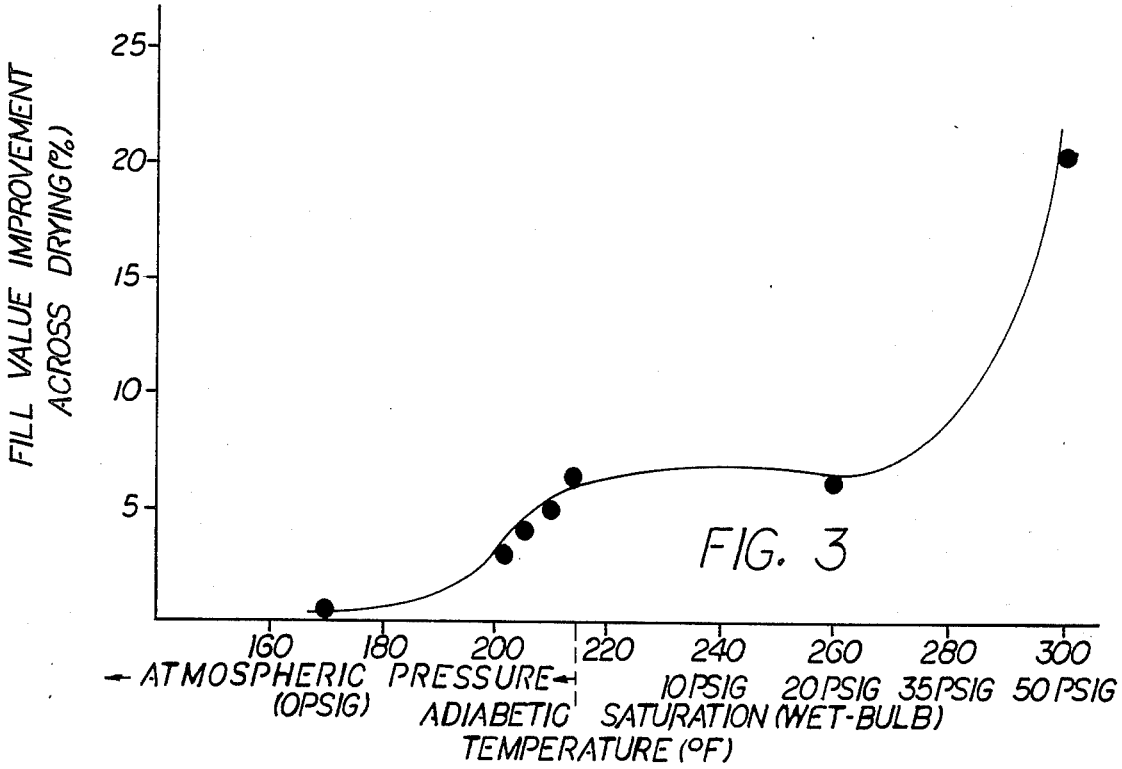

Referring to FIG. 1 of the drawings, in the invention process, saturated steam is supplied to overall system 2 from a suitable primary supply source such as a boiler (not shown) through supply line 3. The pressurized saturated steam passes through primary supply valve 4 and three-way valve 6. In accordance with one feature of the present invention and, if considered desirable to alter convective heat transfer rates or to change from product properties, a secondary gas such as helium, neon, hydrogen, or air, some with a high conventive heat transfer coefficient can be introduced into system 2 through three-way valve 6. Continuing along supply line 3, at three-way valve 7, the pressurized saturated steam can be diverted only into superheater 8 by way of line 9, or passed through both superheater 8 and superheater 11. If three-way valve 7 is set to pass steam through both superheaters 8 and 11, steam passes through superheater 11 to exit line 12 on its way to three-way valve 13. Three-way valve 13 can be set to allow flow into superheater 8, but prevent back flow along line 9. Upon passing through superheaters 8 and 11, the pressurized steam temperature can be set in the range of approximately 350° F. to 1000° F. It is to be noted that the two superheaters 8 and 11 serve to provide greater flexibility and heating capability depending on the type and moistures of the tobacco to be processed. It also is to be understood that it would be possible to carry out the inventive process without superheaters 8 and 11, depending upon the temperature of the pressurized steam as it is brought into supply line 3 from the primary supply boiler source. When the pressurized steam has reached a preselected temperature it is passed through isolation valve 14 along line 16. In accordance with one feature of the present invention, line 16 is sized to impart a velocity in the range of approximately 800–6000 feet per minute to the steam, advantageously approximately 2500 feet per minute. The pressurized steam is passed along line 16 at the increased velocity below gas lock 17 through which a suitably selected tobacco to be treated enters into the system. Such tobacco generally has a moisture content in the range of 16% to 65% upon system entry. The gas or air lock 17 is so designed to maintain high differential pressures between its inlet and discharge with minimum leakage. Although a rotary type lock is schematically disclosed, it is to be understood that other types of feed mechanisms—such as tapered screw feeders—also can be used.

In accordance with the present invention, the tobacco to be treated in the drying system is introduced at the top of confined chute 18 through inlet 19 by a suitable conveyor (not shown). It has been found to be desirable that the inlet 19 of confined chute 18 be positioned above the gas lock a sufficient distance to disentrain the tobacco to be treated from any steam being discharged from the system through the rotating pockets of the lock. Advantageously, a tobacco drop of 4 to 8 feet in the chute has been found to be effective in this regard. It also has been found desirable to size the cross-sectional area of the chute relative to the system line to allow rapid depressurization of any steam discharged from the system through the rotating pockets of the lock so as to decrease steam velocity to a level at least as low as 150 feet per minute (the approximate fluidization value of tobacco) and advantageously less than 50 feet per minute. A cross-sectional area ratio of less than 0.03 to 1 between line 16 and chute 18 has been found advantageous.

Upon entrance of the tobacco into the system through lock 17, it is entrained in the high velocity pressurized steam and moved along line 21 through heat exchanger 22. Although any one of a number of known heat exchangers can be utilized in carrying out the inventive process, it has been found advantageous to utilize a series of steam-to-steam heat exchangers of concentric conduits positioned in horizontal flow fashion with the pressurized steam and tobacco entrained therein passing along the inside conduits and saturated steam supplied from a boiler (not shown) at a pressure of at least 60 psig flowing along the outside conduits. Heat exchanger 22 serves to maintain the heat of the pressurized superheated steam with the tobacco entrained therein for a preselected residence time, advantageously in the range of 3 to 30 seconds. It is to be noted that the temperature of the steam—usually 365° F. at 150 psig from a factory boiler—brought to the outside conduits of the heat exchanger is usually below the temperature of the tobacco entrained pressurized and superheated steam on the inside conduits of the heat exchanger 22 so that no heat is transferred to the steam being treated by exchanger 22, the exchanger acting primarily as an insulating unit to enhance treating residence time. It is to be understood, however, that other combinations of heat exchangers and types such as electric band heaters can be utilized and that, if desired, such heat exchangers can serve to provide additional heat to the tobacco entrained pressurized superheated steam. Further, under certain select conditions, it would be possible to avoid use of heat exchangers at this point entirely.

From heat exchanger 22 in the system disclosed, the tobacco entrained pressurized superheated steam is passed to a suitable steam-tobacco separator 23, which can be any of a number of known gas particle separators, such as cyclones or tangentials, and which, in the advantageous embodiment disclosed, is of the cyclone type. The tobacco entrained in the steam is disentrained from the steam by separator 23, the steam exiting from the top of the separator by way of line 24 passing through back pressure valve 26 after which its remaining heat can be utilized in other factory operations or recycled back to the superheaters 8 and 11 with the aid of a compressor or recirculation blower to restore pressure losses that might have occurred during the drying cycle.

It is to be noted that back pressure valve 26 serves as the primary means to control pressure within system 2. By partially closing valve 26, steam flow is restricted in the system to create a back pressure in the system and permitting pressure control within the system to minimum pressures within the range of approximately 20–60 psig and advantageously above 50 psig.

The tobacco separated from the steam by the cyclone 23 is discharged through gas lock 27, which can be similar to gas lock 17 above discussed with the same conditions applying. The pressure above gas lock 27, which is in the system, is greater than the pressure outside or below gas lock 27, which is outside the system and which can be ambient. As a consequence, the rapid depressurization in the lower pressure zone assists in removing the tobacco from the gas lock pockets without further mechanical means.

In accordance with the present invention, it is desirable that the disentrained, depressurized tobacco exiting from gas lock 27 be allowed to pass through a distance of 5 to 8 feet before reaching a conveyor (not shown) for further processing to reduce tobacco velocity and to thus minimize undesirable tobacco particle impact.

The several examples of data collected from testing selected tobacco samples as set forth hereinafter serve to illustrate the benefits and advantages of the inventive process described herein when compared with data collected from control samples processed under differing conditions.

EXAMPLE 1

Lamina

A standard lamina tobacco blend of flue-cured, oriental, burley and reconstituted types of tobacco having an inlet moisture of 20.6% was fed to a dryer arrangement of the general type which is illustrated in the schematic flow diagram of FIG. 1, the dryer being operated at 23 psig steam pressure and a feed rate of 400 pounds per hour. A control sample was prepared using a drying process described in aforenoted U.S. Pat. No. 4,167,191, operating at 0 psig and 210° F. wet-bulb temperature. Both samples were dryed to final cigarette making moistures and equilibrated in a 60% relative humidity, 75° F. environment prior to analytical testing. Upon testing by a panel of smokers, the sample produced at 23 psig was found to have significantly less impact and irritation than the control sample. Physical and operating data is presented in TABLE 1 below.

TABLE 1

| | LAMINA | |
|---|---|---|
| | TEST | CONTROL |
| Operating pressure (psig) | 23 | 0 |
| Feed rate (# wet/hr.) | 400 | 1000 |
| Inlet tobacco moisture (%) | 22.3 | 18.8 |
| Exit tobacco moisture (%) | 10.6 | 13.9 |
| Inlet tobacco filling power (cc/g) | 4.1 | 4.3 |
| Exit tobacco filling powder (cc/g) | 4.0 | 4.6 |
| Exit Ro-Tap psd | | |
| +6 mesh (%) | 19.3 | 49.9 |
| +9 mesh (%) | 50.7 | 72.7 |
| −14 mesh (%) | 20.9 | 10.7 |
| Inlet alkaloids (%) | 2.5 | 2.3 |
| Exit alkaloids (%) | 2.3 | 2.2 |
| Exit tobacco acetone spec. vol. (cc/g) | 0.97 | 0.94 |
| Cigarette tar (mg/cig) | 14.2 | 14.8 |
| Cigarette nicotine (mg/cig) | 1.0 | 1.1 |
| Specific volume (cc/g) | 1.03 | 1.06 |

EXAMPLE 2

Lamina

Two standard lamina blends of tobacco were dryed in an arrangement of the type shown in the schematic flow diagram of FIG. 1. Each blend was comprised of flue-cured, oriental, burly, and reconstituted tobacco types with Blend A being lightly cased and Blend B having a heavier, more gummy casing. Both blends were dryed at 0 and 24 psig at equivalent feed rates. For comparison purposes in TABLE 2 below, the 0 psig sample is designated the CONTROL sample and the 24 psig is designated the TEST sample. Upon testing by a panel of smokers, the 24 psig TEST sample was found to have significantly less impact and irritation than the 0 psig CONTROL sample. Physical and operating data is presented in TABLE 2 below.

TABLE 2

| | LAMINA | | | |
|---|---|---|---|---|
| | BLEND A | | BLEND B | |
| | CON-TROL | TEST | CON-TROL | TEST |
| Operating pressure (psig) | 0 | 24 | 0 | 24 |
| Inlet tobacco moisture (%) | 18.3 | 18.3 | 21.5 | 21.5 |
| Exit tobacco moisture (%) | 12.2 | 11.8 | 13.0 | 12.9 |
| Inlet tobacco filling power (cc/g) | 4.5 | 4.5 | 4.5 | 4.5 |
| Exit tobacco filling power (cc/g) | 4.6 | 4.5 | 4.3 | 4.4 |
| Exit Ro-Tap psd | | | | |
| +6 mesh (%) | 36.4 | 15.6 | 26.0 | 17.9 |
| +9 mesh (%) | 63.8 | 46.9 | 56.0 | 47.8 |
| −14 mesh (%) | 15.0 | 22.4 | 19.1 | 23.2 |
| Inlet alkaloids (%) | 2.2 | 2.2 | 2.1 | 2.1 |
| Exit alkaloids (%) | 1.9 | 1.8 | 1.8 | 1.6 |
| Cigarette tar (mg/cig) | 11.5 | 10.5 | 19.8 | 18.4 |
| Cigarette nicotine (mg/cig) | 0.80 | 0.71 | 1.24 | 1.10 |

EXAMPLE 3

Lamina

A standard lamina blend comprising the four basic types of tobacco described in EXAMPLES 1 and 2 was dryed in an arrangement of the type shown in the schematic flow diagram of FIG. 1 at three different drying pressures to two different final moisture contents. All of the samples were reconditioned to equilibrium moisture using an atmosphere of 60% relative humidity, 75° F. temperature prior to analysis. Results of the testing are set forth below in TABLE 3 with average results of the two different moistures being illustrated. For comparison purposes, the sample dryed to 14% moisure at 0 psig is considered as the CONTROL sample.

TABLE 3

| | LAMINA | | | | | |
|---|---|---|---|---|---|---|
| | NOMINAL EXIT DRYER MOISTURE | | | | | |
| | 14% | | | 6% | | |
| Operating pressure (psig) | 0 | 20 | 50 | 0 | 20 | 50 |
| Inlet tobacco moisture (%) | 21.6 | 21.6 | 21.6 | 21.6 | 21.6 | 21.6 |
| Exit tobacco moisture (%) | 12.4 | 13.8 | 15.6 | 5.1 | 5.0 | 5.5 |
| Inlet tobacco filling power (%) | 4.49 | 4.49 | 4.49 | 4.49 | 4.49 | 4.49 |
| Exit tobacco filling power (%) | 4.84 | 4.74 | 5.05 | 4.81 | 5.02 | 5.68 |
| Exit Ro-Tap psd | | | | | | |
| +6 mesh (%) | 40.1 | 34.7 | 35.0 | 18.9 | 7.1 | 27.2 |
| −14 mesh (%) | 14.4 | 13.9 | 14.8 | 22.9 | 32.9 | 17.8 |
| Inlet alkaloids (%) | 2.09 | 2.09 | 2.09 | 2.09 | 2.09 | 2.09 |
| Exit alkaloids (%) | 1.92 | 1.62 | 1.31 | 1.76 | 1.35 | 1.21 |
| Specific volume (cc/g) | 1.10 | 1.12 | 1.23 | 1.34 | 1.76 | 1.54 |
| From TABLE 3, it was determined that the following changes occur across the drying operation. | | | | | | |
| Fill value improvement (%) | 7.8 | 5.6 | 12.5 | 7.1 | 11.8 | 26.5 |
| Alkaloids loss (%) | 8.1 | 22.4 | 37.3 | 15.8 | 35.4 | 42.1 |

EXAMPLE 4

Stem

The procedures described in EXAMPLE 1, were followed except lamina was replaced with a highly expanded stem. The resulting test data for this type of material as set forth in TABLE 4 below indicates the benefits in physical properties which can be achieved with the present inventive process.

TABLE 4

| | STEM | |
|---|---|---|
| | TEST | CONTROL |
| Operating pressure (psig) | 23 | 0 |
| Feed rate (wet #/hr) | 175 | 70 |
| Inlet stem moisture (%) | 39.3 | 39.3 |
| Exit stem moisture (%) | 18.0 | 11.6 |
| Inlet stem filling power (cc/g) | 5.0 | 5.0 |
| Exit stem filling power (cc/g) | 6.5 | 6.0 |
| Exit Ro-Tap psd: | | |
| +6 mesh (%) | 43.0 | 24.5 |
| +9 mesh (%) | 85.0 | 69.3 |
| −14 mesh (%) | 2.5 | 8.2 |
| Inlet stem alkaloids (%) | 0.6 | 0.6 |
| Exit stem alkaloids (%) | 0.6 | 0.5 |
| Exit acetone specific volume (cc/g) | 1.52 | 1.53 |

Thus, from the description set forth herein and the collected testing data, it can be seen that the inventive process makes it possible to obtain an improved tobacco product for smoking articles, such as cigarettes, which not only provides smoother smoking qualities with lower impact and irritation and with lower nicotine and alkaloid type ingredients, but also, at the same time, can provide increased fill values.

The invention claimed is:

1. A process for drying tobacco comprising: introduction pressurized superheated steam into a restricted pressure and flow controllable system; controlling the pressure differential and velocity flow of said superheated steam across said system so that said steam is at a preselected velocity to entrain a preselected minimum pressure range of approximately 20–60 psig to improve the smoking quality and fill value of tobacco to be introduced into said system; introducing tobacco to be dryed through a first gas lock into said system to be entrained by said pressurized steam for a preselected residence time in said system; disentraining the tobacco from said residence time; and discharging the disentrained tobacco from said system through a second gas lock into a zone of lower pressure.

2. The process of claim 1, the pressurized steam being maintained in said system at not below approximately 50 psig.

3. The process of claim 1, includng superheating said steam within said system to a temperature range of approximately 350°–1000° F.

4. The process of claim 1, including superheating said steam within said system in at least two heat zones in accordance with type and moisture content of tobacco to be introduced into said system.

5. The process of claim 1, including introducing a secondary gas with a high convective heat transfer coefficient into the pressurized saturated steam in said system to alter heat transfer rates and final product properties.

6. The process of claim 1, said superheated steam being maintained at a velocity in the range of approximately 800–6000 feet per minute.

7. The process of claim 1, said superheated steam being maintained at a velocity of approximately 2500 feet per minute.

8. The process of claim 1, said tobacco having an introduction moisture content of approximately 16–65%.

9. The process of claim 1, said tobacco being introduced into said first airlock from a preselected confined height to disentrain tobacco from returning pockets of said first airlock.

10. The process of claim 1, said tobacco being introduced into said first airlock from a height of approximately 4 to 8 feet.

11. The process of claim 1, said tobacco being introduced into the closed system having a conduit carrying the superheated steam at a preselected velocity through a confined chute leading into said first airlock, the cross-sectional area between the conduit and the chute being in a ratio of less than 0.03 to 1.0.

12. The process of claim 1, including passing said tobacco entrained steam through a heat exchange zone in said system to maintain the heat level in said steam for a preselected time.

13. The process of claim 1, including passing said tobacco entrained steam through a heat exchange zone to maintain said steam at approximately 350° F. for a preselected time.

14. The process of claim 1, said preselected residence time being in the range of approximately 3 to 30 seconds.

15. The process of claim 1, said tobacco being disentrained from said steam by centrifugal force.

16. The process of claim 1, said tobacco being disentrained from said steam by centrifugal force through a tangential separator.

17. The process of claim 1, said disentrained tobacco passing through a height of approximately 4 to 8 feet in said zone of lower pressure before further processing.

18. A process for drying tobacco comprising: introducing pressurized superheated steam into a restricted pressure and flow controllable system; controlling the pressure differential and velocity flow of said superheated steam across said system so that said system is at a preselected velocity to entrain and a preselected minimum pressure to improve the smoking quality and fill value of tobacco to be introduced into said system; introducing a secondary gas selected from the group consisting of helium, hydrogen, neon, or air, some with a high connective heat transfer coefficient into the pressurized steam in said system to alter heat transfer rates and final product properties; introducing tobacco to be dryed through a first gas lock into said system to be entrained by said pressurized steam for a preselected residence time in said system; disentraining the tobacco from said pressurized steam at the end of said residence time; and discharging the disentrained tobacco from said system through a second gas lock into a zone of lower pressure.

19. A process for drying tobacco comprising: introducing pressurized steam into a restricted pressure and flow system; controlling the pressures in said system to a range of approximately 20–60 psig; superheating the steam to a temperature range of approximately 350°–1000° F.; maintaining the velocity of the superheated steam in the system as approximately 800–6000 feet per minute; introducing tobacco having a moisture content in the range of approximately 16–65% through a confined chute having a height of approximately 4 to 8 feet and a first airlock into a conduit in the closed system to be entrained by said superheated steam moving in said velocity range, the cross-sectional area between the conduit and chute being in a ratio of less than 0.03 to 1.0; passing said superheated steam with the tobacco entrained therein in a sinusoidal horizontal path through heat exchangers at a temperature of approximately 365° F. with the heat exchangers serving as an insulating unit without heat transfer to the internal steam stream to maintain the heat therein for a residence time of approximately 3 to 30 seconds; disentraining the tobacco from said steam by centrifugal force through a separator; discharging the disentrained tobacco from said closed system through a second gas lock into a depressurized ambient zone, said disentrained tobacco passing through a height of approximately 4 to 8 feet in said zone of lower pressure before further processing.

* * * * *